US011319734B2

(12) United States Patent
Hansen

(10) Patent No.: US 11,319,734 B2
(45) Date of Patent: May 3, 2022

(54) UNLOCKING UNIT HAVING A VARIABLE TRIGGER SWITCH POINT

(71) Applicant: Volkswagen Aktiengesellschaft, Wolfsburg (DE)

(72) Inventor: Ralf Hansen, Lehre (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 613 days.

(21) Appl. No.: 16/362,575

(22) Filed: Mar. 22, 2019

(65) Prior Publication Data

US 2019/0218832 A1 Jul. 18, 2019

Related U.S. Application Data

(63) Continuation of application No. PCT/EP2017/073427, filed on Sep. 18, 2017.

(30) Foreign Application Priority Data

Sep. 22, 2016 (DE) ..... 10 2016 218 206.4

(51) Int. Cl.
*E05B 83/18* (2014.01)
*E05B 85/14* (2014.01)
(Continued)

(52) U.S. Cl.
CPC ..... *E05B 83/18* (2013.01); *E05B 63/0056* (2013.01); *E05B 81/76* (2013.01); *E05B 85/14* (2013.01); *E05B 77/04* (2013.01)

(58) Field of Classification Search
CPC ..... E05B 83/18; E05B 63/0056; E05B 81/76; E05B 85/14; E05B 85/18; E05B 85/10;
(Continued)

(56) References Cited

U.S. PATENT DOCUMENTS 2,466,481 A * 4/1949 Royal ..... E05B 77/48 292/144
6,696,652 B1 * 2/2004 Spies ..... H01H 9/02 200/61.62

(Continued)

FOREIGN PATENT DOCUMENTS

CN 1041074 A 4/1990
CN 1571087 A 1/2005

(Continued)

OTHER PUBLICATIONS

International Search Report dated Jan. 3, 2018 in corresponding application PCT/EP2017/073427.

*Primary Examiner* — Kristina R Fulton
*Assistant Examiner* — Emily G. Brown
(74) *Attorney, Agent, or Firm* — Muncy, Geissler, Olds & Lowe, P.C.

(57) ABSTRACT

An unlocking unit for unlocking an openable closure element of a motor vehicle, having a housing with a switch unit and an actuating element that can be pivoted relative to the housing and pivoted relative to the switch unit from an unactuated resting position into at least two actuating positions. It is provided that the switch unit is positioned in the housing and can be reversibly positioned in at least two different switch point positions relative to the housing, whereby different trigger switch points can be assigned the pivotable actuating element of the unlocking unit in accordance with a switch angle of the actuating element that can be pivoted out of the resting position.

10 Claims, 6 Drawing Sheets

(51) Int. Cl.
*E05B 81/76* (2014.01)
*E05B 63/00* (2006.01)
*E05B 77/04* (2014.01)

(58) Field of Classification Search
CPC ..... E05B 76/06; E05B 79/22; E05B 86/04; E05B 63/044; H01H 23/12; H01H 23/14; H01H 23/16; H01H 23/162; H01H 23/24
USPC ..... 292/244, 1
See application file for complete search history.

(56) References Cited

U.S. PATENT DOCUMENTS

| | | | | |
|---|---|---|---|---|
| 7,057,124 | B2 | 6/2006 | Ieda et al. | |
| 7,891,886 | B2 | 2/2011 | Schuetz | |
| 9,004,570 | B1 * | 4/2015 | Krishnan | E05B 81/22 296/76 |
| 10,141,138 | B2 * | 11/2018 | Kang | B60R 11/00 |
| 2001/0053203 | A1 | 12/2001 | Ishii et al. | |

FOREIGN PATENT DOCUMENTS

| | | | |
|---|---|---|---|
| DE | 19620984 | A1 | 11/1997 |
| DE | 19930861 | A1 | 1/2001 |
| DE | 60015463 | T2 | 3/2005 |
| DE | 102005040761 | A1 | 3/2007 |
| DE | 102006048371 | A1 | 4/2008 |
| DE | 102006048373 | A1 | 4/2008 |
| DE | 102008010966 | A1 | 8/2009 |
| DE | 102013013176 | A1 | 2/2014 |
| EP | 1 162 332 | A1 | 12/2001 |
| JP | 2010-505687 | A | 2/2010 |
| JP | 2014-172572 | A | 9/2014 |

* cited by examiner (Fig. 2A/2B)

UNLOCKING UNIT HAVING A VARIABLE TRIGGER SWITCH POINT

This nonprovisional application is a continuation of International Application No. PCT/EP2017/073427, which was filed on Sep. 18, 2017, and which claims priority to German Patent Application No. 10 2016 218 206.4, which was filed in Germany on Sep. 22, 2016, and which are both herein incorporated by reference.

BACKGROUND OF THE INVENTION

Field of the Invention

The present invention relates to an unlocking unit for unlocking an openable closure element, in particular a tailgate of a motor vehicle, comprising a switch unit and a pivotable actuating element that can be pivoted relative to the switch unit from an unactuated resting position into at least two actuating positions.

Description of the Background Art

A device for opening a closure element of a motor vehicle is known from document DE 10 2013 013 176 A1; the device comprises a pivotable actuating element, which is pivotable out of a resting position into an open activation position. The closure element can be, for example, a tailgate. The device further comprises a switch unit. It is provided that the actuating element can be pivoted into different activation positions and the switch unit comprises multiple switching stages, wherein the switching stages are each assigned to an activation position of the actuating element. The actuating element is pivoted in each of the activation positions into a different angular position. In this case, the switch unit comprises multiple switching stages, wherein the switching stages each correspond to an activation position of the pivotable actuating element. According to the cited document DE 10 2013 013 176 A1, different mechanisms can be activated due to the multiple switching stages, for example, merely unlocking the closure element so as to open it manually by hand, or an automatic opening of the closure element. Different activation positions are thus generated by different pivot positions of the actuating element, wherein the actuating element in each activation position is pivoted into a different angular position.

A pivotable actuating element with a device for opening a closure element, in particular a tailgate, in different activation positions is also known in another context. An actuating member of the pivotable actuating element generates a switch point at a switch of an unlocking unit depending on the pivot angle of the pivotable actuating element relative to a housing part in which the switch is fixedly disposed. In the assembled state, the housing part and the actuating element form the device which is used, for example, as the unlocking unit of a closure element, in particular the tailgate. The assembly of the housing part with the switch already integrated in the housing, as the first subassembly, and the assembly of the pivotable actuating element with the already integrated actuating member, as a second subassembly, are regarded as the assembled state of the unlocking unit. In other words, the two subassemblies together form the unlocking unit of the closure element, in particular of the tailgate, and are installed in the assembled state in the tailgate.

In practice, it is desired that different switch points can be realized in different motor vehicles, but the switch points are not to be generated depending on the pivot angle of the pivotable actuating element, as in the already described document DE 10 2013 013 176 A1. So far, in conventional unlocking units the switch point is not set as a function of the pivot angle of the pivotable actuating element relative to the housing part, in which the switch is disposed fixedly, but different actuating elements, which differ in that the actuating members on the actuating element have different geometric configurations, are used as the second subassembly, whereby they are positioned in different positions relative to the switch with an otherwise unchanged installation of the actuating element, whereby different switch points result at the same pivot angle of the actuating elements, differing in the actuating members, relative to the housing part, on the switch integrated into the housing part. It is understood that different switch points result further due to the different geometric configuration of the actuating members on an actuating element also at different pivot angles of the pivotable actuating element relative to the housing part.

The disadvantage in summary is thus that on the assembly line for different vehicles with desired differing switch points, different actuating elements must be produced as second subassemblies, held in stock, and assigned without mix-up to the always identically used first subassembly, therefore to the housing part, and installed.

SUMMARY OF THE INVENTION

It is therefore an object of the present invention to provide an unlocking unit which can be used in a variable manner.

In an exemplary embodiment of the invention an unlocking unit is provided for unlocking an openable closure element of a motor vehicle, comprising a housing with a switch unit and an actuating element that can be pivoted relative to the housing and pivoted relative to the switch unit from an unactuated resting position into at least two actuating positions.

The switch unit can be positioned in the housing and can be reversibly positioned in at least two different switch point positions relative to the housing, whereby different trigger switch points can be assigned to the pivotable actuating element of the unlocking unit in accordance with a switch angle of the actuating element that can be pivoted out of the resting position.

The openable closure element is, for example, a tailgate. The unlocking unit is either disposed directly in the tailgate or is disposed in another structural component of a motor vehicle and serves to unlock the tailgate. The openable closure element can be any type of cover, wherein the unlocking unit is disposed in the cover itself or in another structural component for unlocking the cover.

The solution of the invention has the advantage that different trigger switch points can be realized by means of a single switch unit as a result of the different positioning of the switch unit in an unlocking unit. The unlocking unit thus can be used variably, because it can be installed in any vehicle, regardless of whether different trigger switch points are desired on the vehicle side. The trigger switch point can be changed at any time before or after the unlocking unit is used, because at least two different switch point positions can be set. So far, different unlocking units have been used with differing trigger switch points for different vehicles, which are now replaced by a single unlocking unit, whereby the number of parts decreases in an advantageous manner.

The switch unit of the unlocking unit can be fixedly positioned integrated in a holding element, which, in the assembled state of the unlocking unit, is positioned in the housing and can be reversibly positioned in the at least two different switch point positions relative to the housing.

This has the advantage that the switch unit is disposed protected in a holding element, wherein furthermore different switch units can be used, which can be used by simple adaptation of the mount for the switch unit in the holding element. An adaptation of the holding element relative to the housing depending on the different switch units is thus advantageously not necessary.

The housing of the unlocking unit can have a receiving opening, which, in the assembled state of the unlocking unit, is penetrated at least by the integrated switch unit or by the holding element and the integrated switch unit, so that in the unactuated resting position of the pivotable actuating element, depending on the positioning of the switch unit in one of the at least two switch point positions, the switch unit is positioned at a predeterminable distance from an actuating member of the pivotable actuating element. This solution is advantageous in terms of the adjustment of the switch unit relative to the actuating element. A precise adjustment in the switch unit in the holding element can be realized in that the switch unit is inserted through the receiving opening, after which the switch unit is locked or clipped in a predetermined position in the holding element, as explained in greater detail in the description. In any case, the holding element in turn can be positioned precisely inside the housing, for which purpose corresponding guide elements are disposed on the holding element, which engage in respectively disposed positioning recesses of the housing in both of the at least two switch point positions, as is likewise explained in detail in the description.

Starting from the unactuated resting position of the pivotable actuating element, depending on the positioning of the switch unit in a first switch point position, a first distance between the switch unit and the actuating member can be set, which distance is overcome in a first actuating position upon actuation of the pivotable actuating element about the first switch angle, whereby a first trigger switch point between the actuating member and the switch unit can be effected.

Starting from the unactuated resting position of the pivotable actuating element, depending on the positioning of the switch unit in a second switch point position, a second distance between the switch unit and the actuating member can be set, which distance is overcome in a second actuating position upon actuation of the pivotable actuating element about the second switch angle, whereby a second trigger switch point between the actuating member and the switch unit can be effected.

The holding element with the integrated switch unit can be positioned displaceable relative to the housing in the receiving opening of the housing, whereby an advantageous solution is provided, which can be realized with little effort and is particularly easy to implement because only a local repositioning of the holding element is necessary for setting different switch point positions.

The holding element and the switch unit can be stationary relative to one another as the first prefabricated subassembly, and the pivotable actuating element and the actuating member are stationary relative to one another as a second prefabricated subassembly, which can be assembled to form the unlocking unit, wherein the actuating element is pivotally mounted in the housing and the holding element is displaceably mounted in the receiving opening of the housing. In an advantageous manner, it is achieved that a worker on the assembly line only has to join together the prefabricated subassemblies to form the unlocking unit.

The housing can have an arcuate section at least in the region of the positioned holding element, so that the holding element, positioned in the housing, with the integrated switch unit is displaceably positioned relative to the housing on a circular arc, wherein a radius of the arc is disposed radially to a pivot axis of the actuating element pivotable relative to the housing. This achieves in an advantageous manner that the distance of a switch surface of the actuating member of the actuating element in its resting position relative to a switch element of the switch unit, depending on the displacement path of the holding element with the integrated switch unit, in the case of a small displacement path results in a relatively great change in distance relative to the switch surface of the actuating member of the actuating element, because a movement of the holding element on the arc geometrically causes a faster approach of the switch element of the integrated switch unit relative to the switch surface of the actuating member of the actuating element.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1B:
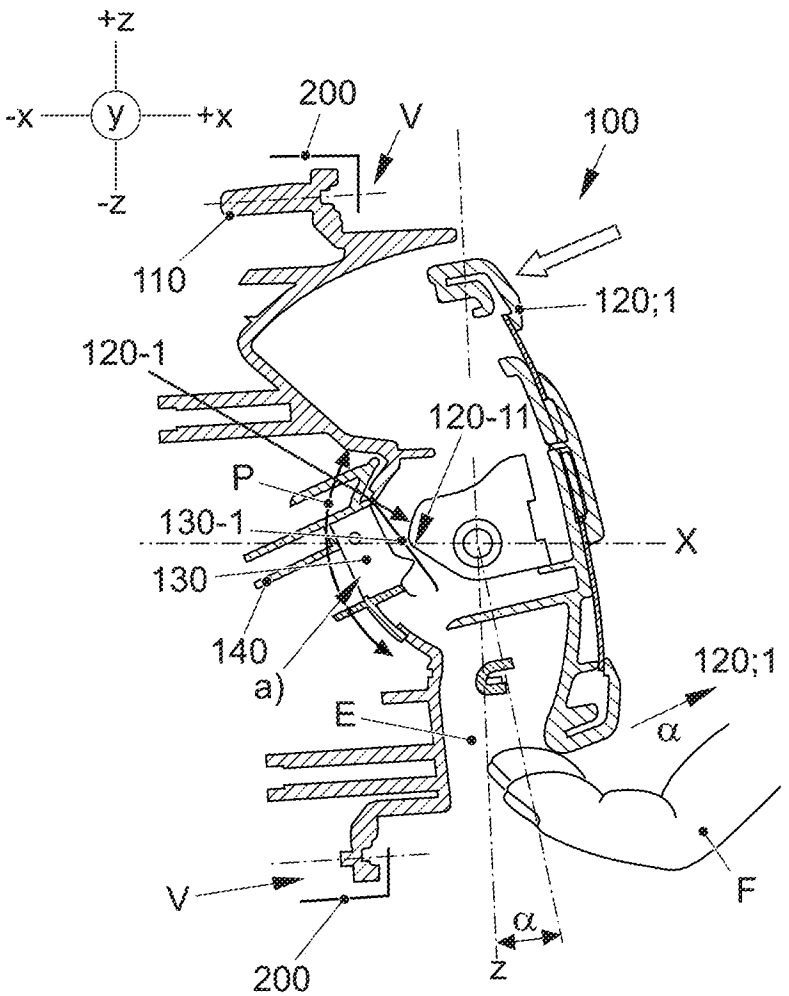
FIG. 1B shows a sectional view of the unlocking unit according to FIG. 1A, wherein the switch unit is positioned opposite to the actuating element of the unlocking unit in the early switch point position and the actuating element is positioned in a first actuating position.

The invention will be described hereinafter with use of the accompanying drawings. For the purposes of the present description, the conventional direction of travel of a vehicle is designated with "−x" ("minus x"), and the direction opposite to its conventional direction of travel with "+x" ("plus x"); the direction in the horizontal plane transverse to the x-direction is designated with "y" and the direction in the vertical plane transverse to the x-direction with "z." This terminology for the spatial directions in Cartesian coordinates corresponds to the coordinate system generally used in the automotive industry.

The figures show an unlocking unit 100, which is disposed in a structural element 200, which is shown only suggestively in FIGS. 1A to 2B.

The structural element is, for example, a tailgate. Unlocking unit 100 is, for example, a tailgate unlocking unit.

Unlocking unit 100 comprises a housing 110 which is in a fixed connection V with structural element 200. A pivotable actuating element 120, which is pivotable relative to housing 110 about a Y-axis, is disposed in housing 110, whereby actuating element 120 is displaceable relative to structural element 200. Between housing 110 and a lower end of actuating element 120, which is also referred to as a handle flap, an engagement gap E is provided in an unactuated resting position 0 of actuating element 120. A user of unlocking unit 100 can engage with his fingers F in engagement gap E and actuate actuating element 120, in particular pivot it about pivot axis Y into one of multiple actuating positions 1, 2, which will be discussed further in detail.

Actuating element 120 has an actuating member 120-1, which has an outer contour, wherein a partial surface of the outer contour forms a switch surface 120-11 which strikes at least one switch of a switch unit 130 in the respective actuating position 1, 2 of the multiple actuating positions. Actuating member 120-1 of actuating element 120 is a switch cam in the exemplary embodiment.

Actuating element 120 with the already integrated actuating member 120-1 is provided prefabricated as a second subassembly and is pivotally mounted in housing 110. In other words, the position of integrated actuating member 120-1, in particular of the switch cam, relative to the handle flap of actuating element 120 is no longer changeable after the assembly of the second subassembly.

The switch cam is disposed substantially on a longitudinal central axis X of actuating element 120, wherein the longitudinal central axis X intersects pivot axis Y of actuating element 120, said pivot axis Y extending orthogonally to the longitudinal central axis X.

Housing 110 is disposed in the extension of longitudinal central axis X of actuating element 120, so that longitudinal central axis X of actuating element 120 is substantially also longitudinal central axis X of housing 110.

A housing opening, which is penetrated by switch 130 in the assembled state, is made in housing 110 substantially on longitudinal central axis X of housing 110.

The switch of switch unit 130 in the assembled state is disposed positionally fixed, in particular clipped, in a holding element 140. Holding element 140 and the switch unit form a first subassembly after assembly, wherein the position of switch unit 130 relative to holding element 140 is no longer changeable after assembly.

Holding element 140 in turn has link-like guide elements 140-1 (compare FIGS. 3 to 5) which are guided in a receiving opening 110-1 (compare FIGS. 3 to 5) in a similar manner to a link of housing 110, so that holding element 140 can be displaced relative to housing 110. Thus, the switch of switch unit 130 is displaceable relative to housing 110.

The double arrow P in FIGS. 1A to 2B thus relates to the displaceability of holding element 140 with the integrated switch of switch unit 130.

Housing 110 in this case has a semicircular inner contour in the region of holding element 140, wherein holding element 140 has a semicircular outer contour corresponding to the semicircular inner contour of holding element 140, so that holding element 140 and thereby the integrated switch of switch unit 130 can be moved up or down on a circular path in +/−z-direction in FIGS. 1A to 2B.

Holding element 140 with the already integrated switch of switch unit 130 is prefabricated as a first subassembly and is mounted reversibly displaceably in housing 110 along the double arrow P.

In other words, the position of holding element 140 with the integrated switch of switch unit 130 can be changed after the assembly of unlocking unit 100 relative to housing 110 and thus relative to the switch cam of actuating element 120.

Figure 1A:
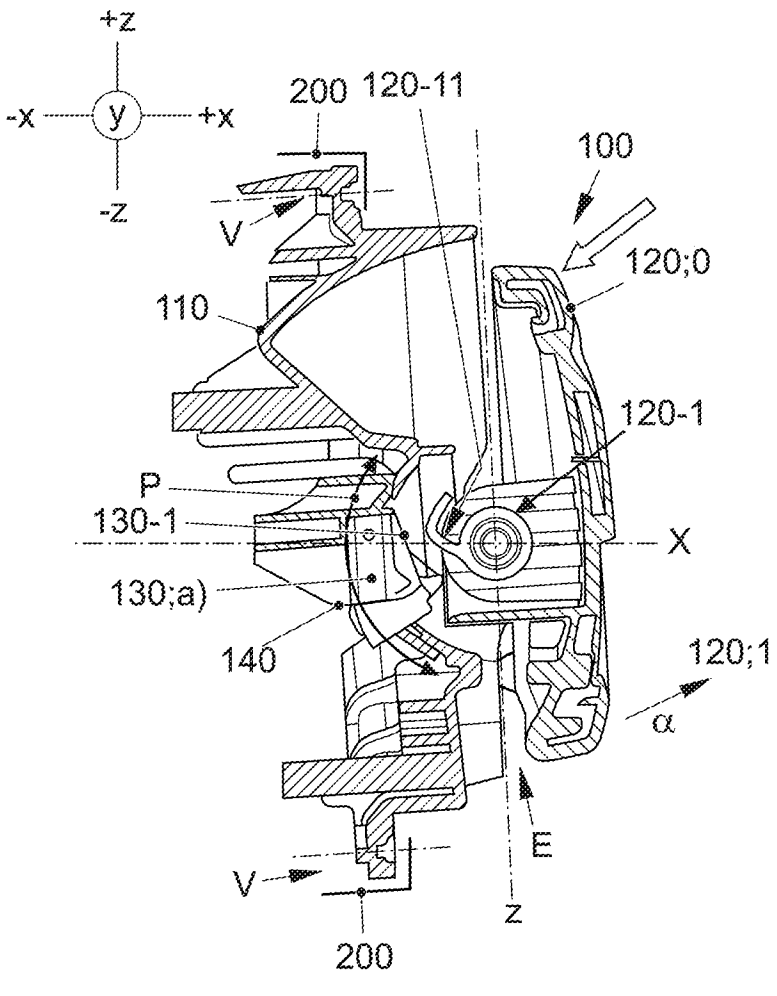
FIG. 1A shows a sectional view of an unlocking unit of the invention, wherein a switch unit of the unlocking unit is positioned opposite an actuating element of the unlocking unit in an early switch point position and an actuating element is positioned in a resting position.

It becomes clear that the switch of switch unit 130 in the case of an actuating element 120, positioned in the unactuated resting position 0, in a first switch point position a) is disposed close to switch surface 120-11 of the outer contour of switch cam 120-1 (see FIG. 1A).

In other words, a first distance between active switch element 130-1 of the switch of switch unit 130 and the outer contour of switch cam 120-1 is small. In the first switch point position a) of the switch of switch unit 130, holding element 140 forms at least one stop relative to housing 110, so that the movement of holding element 140 along the circular path according to the double arrow P in the +z-direction (upwards in FIGS. 1A, 1B) takes place until holding element 140 strikes the housing part of housing 110, said part forming the top stop, whereby the first trigger switch point can be set precisely and without error.

Figure 2B:
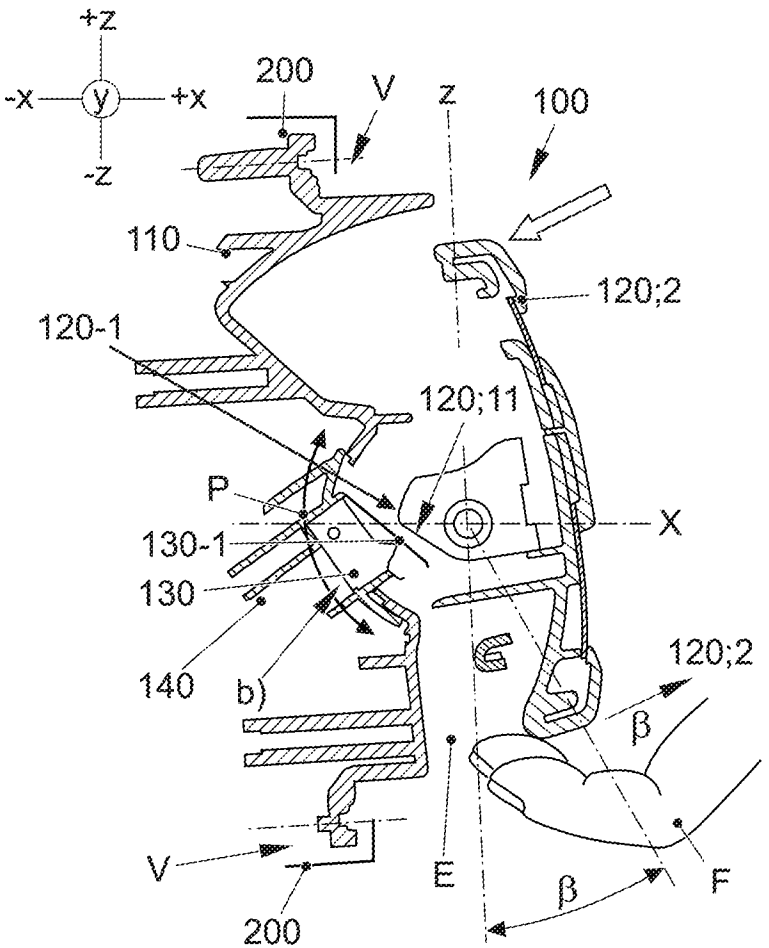
FIG. 2B shows a sectional view of the unlocking unit according to FIG. 2A, wherein the switch unit is positioned opposite to the actuating element in the late switch point position and the actuating element is positioned in a second actuating position.
Figure 2A:
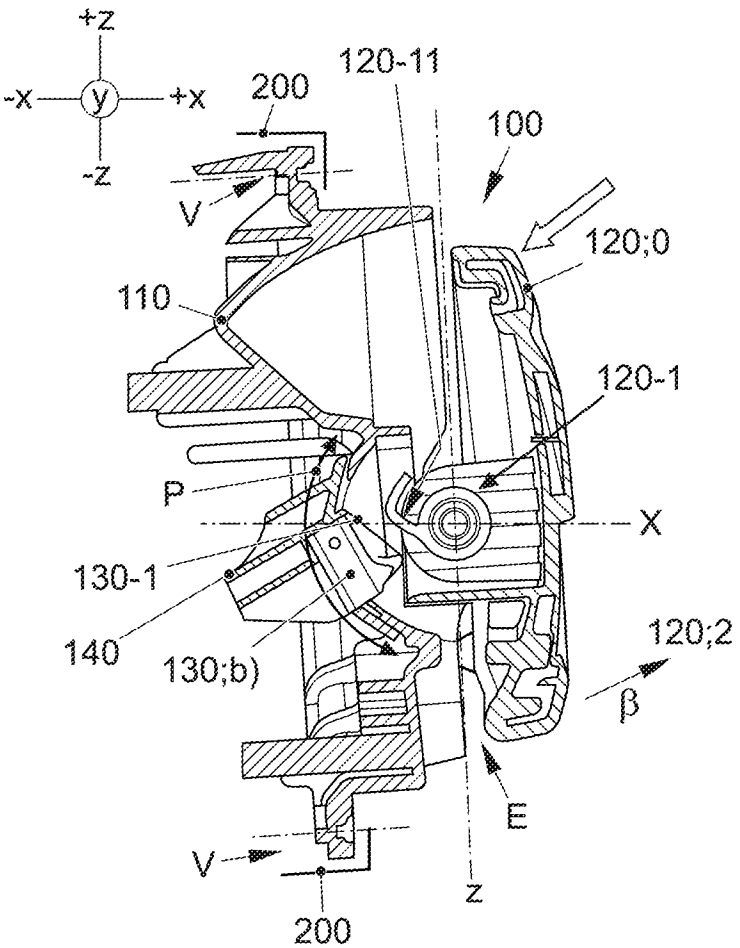
FIG. 2A shows a sectional view of the unlocking unit of the invention, wherein the switch unit of the unlocking unit is positioned opposite the actuating element of the unlocking unit in a late switch point position and the actuating element is positioned in the resting position.

By comparing FIG. 1A with FIG. 2A, it becomes clear that when an actuating element 120 is positioned in the unactuated resting position 0, the switch of switch unit 130 according to FIG. 2A is positioned in a second switch point position b) farther from switch surface 120-11 of the outer contour of switch cam 120-1.

In other words, a second distance between active switch element 130-1 of the switch of switch unit 130 and the outer contour of switch cam 120-1 is greater than the first distance at which the switch of switch unit 130 is in the first switch point position a).

In the second switch point position b) of the switch of switch unit 130, holding element 140 also forms at least one stop relative to housing 110, so that the movement of holding element 140 along the circular path according to the double arrow P in the −z-direction (downward in FIGS. 2A, 2B) takes place until holding element 140 strikes the housing part of housing 110, said part forming the bottom stop, whereby the second trigger switch point can be set precisely and without error.

Active switch element 130-1 of the switch of switch unit 130 is, for example, a metallic switch flag of a micro switch.

The following function emerges from the described configuration of unlocking unit 100:

A trigger switch point will be reached earlier or later depending on whether the switch of switch unit 130 is in the first switch point position a) (compare FIGS. 1A, 1B) or in the second switch point position b) (compare FIGS. 2A, 2B).

According to FIG. 1A, the first distance between active switch element 130-1 of the switch of switch unit 130 and the outer contour of switch cam 120-1 is small, so that due to the actuation of actuating element 120 via the engagement of a user's fingers F in the engagement gap E (compare FIG. 1B) after the setting of a first pivot angle α of actuating element 120 about pivot axis Y, contact takes place between switch surface 120-11 of the outer contour of switch cam 120-1 and active switch element 130-1 of the switch of the switch unit 130.

Starting from the first switch point position a) of the switch, the first switch angle α=10°. Actuating element 120 according to FIG. 1B is in a first actuating position 1 starting from the unactuated resting position 0 after the completed actuation of actuating element 120 by α=10°.

Basically, an actuation can also occur in that the user does not engage in the engagement gap E, but in the upper region of actuating element 120 presses from the outside on actuating element 120, as indicated by the arrow, but then a relatively high operating pressure force must be exerted so that an operating pulling force by the user by engaging in the engagement gap E is perceived as more comfortable.

Consequently, unlocking units 100 can be realized, which should have an early trigger switch point. This early trigger switch point refers to a comfortable operation, in which a switch point is already reached by a small actuating movement of an actuating element 120. Depending on the achieved early trigger switch point, appropriate actuations can be initiated and executed as desired. For example, an unlocking mechanism of a tailgate can be triggered so that the tailgate opens manually or automatically.

According to FIG. 2A, the second distance between active switch element 130-1 of the switch of switch unit 130 and the outer contour of switch cam 120-1 is greater than the first distance, so that due to the actuation of actuating element 120 via the engagement of a user's fingers F in the engagement gap E (compare FIG. 2B) only after the setting of a second pivot angle β of actuating element 120 about pivot axis Y, contact takes place between switch surface 120-11 of the outer contour of switch cam 120-1 and active switch element 130-1 of the switch of switch unit 130.

Starting from the second switch point position b) of the switch, the second switch angle β=27.5°. Actuating element 120 according to FIG. 2B is in a second actuating position 2 starting from the unactuated resting position 0 after the completed actuation of actuating element by β=27.5°.

Consequently, unlocking units 100 can be realized, which should have a late trigger switch point. A later trigger switch point is particularly advantageous for vehicles that do not have a trunk separated from the passenger compartment. In the event of a crash, this ensures that a pivoting movement of actuating element 120 about pivot axis Y caused by the crash occurs late or later, that is, only at a large second switch angle β or a second switch angle β that is greater than the first switch angle α. Corresponding actuations can be carried out as desired via the achieved late trigger switch point, similar to the earlier trigger switch point. For example, an unlocking mechanism of a tailgate can be triggered later, that is, only after the late trigger switch point is reached, so that the tailgate opens manually or automatically.

It is understood that the setting of the trigger switch points within the movement range of holding element 140 relative to housing 110 between the described stops is variable and the angle specifications a, 13 of the switch angle are given by way of example.

Figure 3:
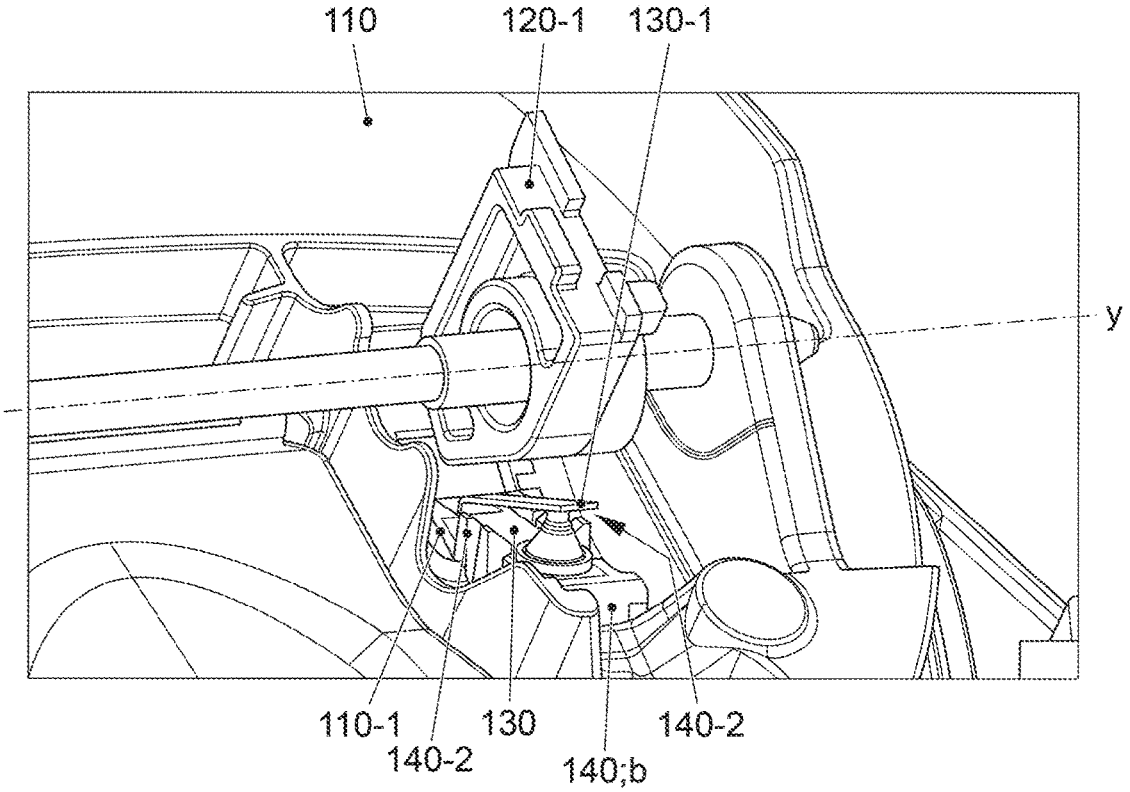
FIG. 3 shows a perspective representation of the unlocking unit laterally obliquely from below with a viewing direction from the actuating element in the direction of a housing of the unlocking unit.

FIG. 3 additionally shows further technical details in a perspective representation of unlocking unit 100 laterally obliquely from below with a viewing direction from actuating element 120 (not shown in FIG. 3) in the direction of housing 110 of unlocking unit 100.

Holding element 140 with integrated switch unit 130 is inserted through receiving opening 110-1 of housing 110. Active switch element 130-1 can be seen, which is directed toward switch cam 120-1 and is the metallic switch flag of the micro switch in the exemplary embodiment. Furthermore, locking elements 140-2 of holding element 140 are shown, by means of which the switch of switch unit 130 in the assembled state is locked/clipped positionally fixed with holding element 140.

Figure 4:
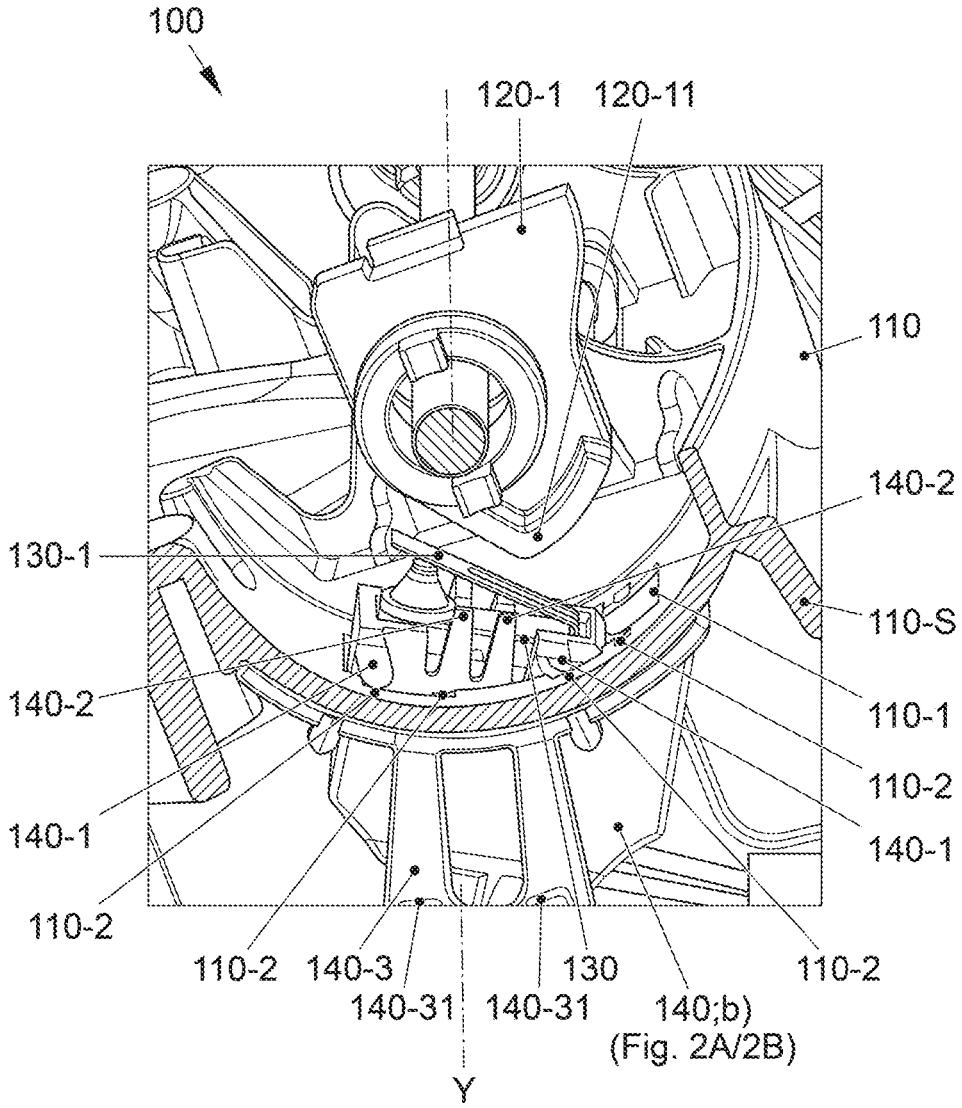
FIG. 4 shows a perspective representation of the unlocking unit laterally looking at an actuating member of an actuating element substantially in the longitudinal direction of a pivot axis of the actuating element.

FIG. 4 shows a perspective representation of unlocking unit 100 in a lateral view of actuating member 120-1 of actuating element 120 substantially in the longitudinal direction of pivot axis Y of actuating element 120. Housing 110 is shown as cut, wherein a cut surface of housing 110 in FIG. 3 is designated by the reference character 110-S. Holding element 140 is positioned in FIG. 3, analogous to FIGS. 2A and 2B, again in the second switch point position b).

In this representation, it becomes clear that holding element 140 further comprises lateral guide elements 140-1, in addition to locking elements 140-2, wherein at least two guide elements 140-1 are disposed laterally in each case. Lateral guide elements 140-1 guide holding element 140 along the edge of the arcuate receiving opening 110-1. Lateral guide elements 140-1 overlap the edge in the assembled state, wherein receiving opening 110-1 of housing 110 has an insertion region into which holding element 140 with its lateral guide elements 140-1 can be inserted and subsequently positioned, so that lateral guide elements 140-1 overlap the edge of receiving opening 110-1. Lateral guide elements 140-1 have on the housing side at one end contours, which engage in positioning recesses 110-2, which correspond with respect to the contour and are located in the edge of receiving opening 110-1 of housing 110.

In the illustrated second switch point position b) of holding element 140, two laterally disposed guide elements 140-1 each engage in two positioning recesses 110-2, with an analogous configuration being present on the non-visible rear side of holding element 140. These provisions have the advantage that the position is secured in the second switch point position b) and a worker perceives the correct position by some kind of latching movement of holding element 140 relative to housing 110. A displacement from the illustrated second switch point position b) to the first switch point position a), to the right in FIG. 4, thus first guides the worker to a perceptible disengaging movement of holding element 140, which after the performed displacement movement of holding element 140 leads to a latching movement in the other provided positioning recesses 110-2.

FIG. 4 shows, still at the bottom edge of the illustration, securing elements 140-31, which are located on plate 140-3 of holding element 140, said plate extending outward when viewed in the radial direction with respect to the Y-pivot axis. Securing elements 140-31 extend in the y-direction and, depending on the switch point position a) or b), engage in a securing mount 110-3 (compare FIG. 6), which is formed in housing 110, as will still be described in connection with the description of FIG. 6. One of securing elements 140-31 secures the position of holding element 140 relative to housing 110 in an advantageous manner by engagement in securing mount 110-3 always in the respective switch point position a) or b), so that a change in the desired trigger switch point does not occur due to an unwanted displacement of holding element 140 relative to housing 110.

Figure 6:
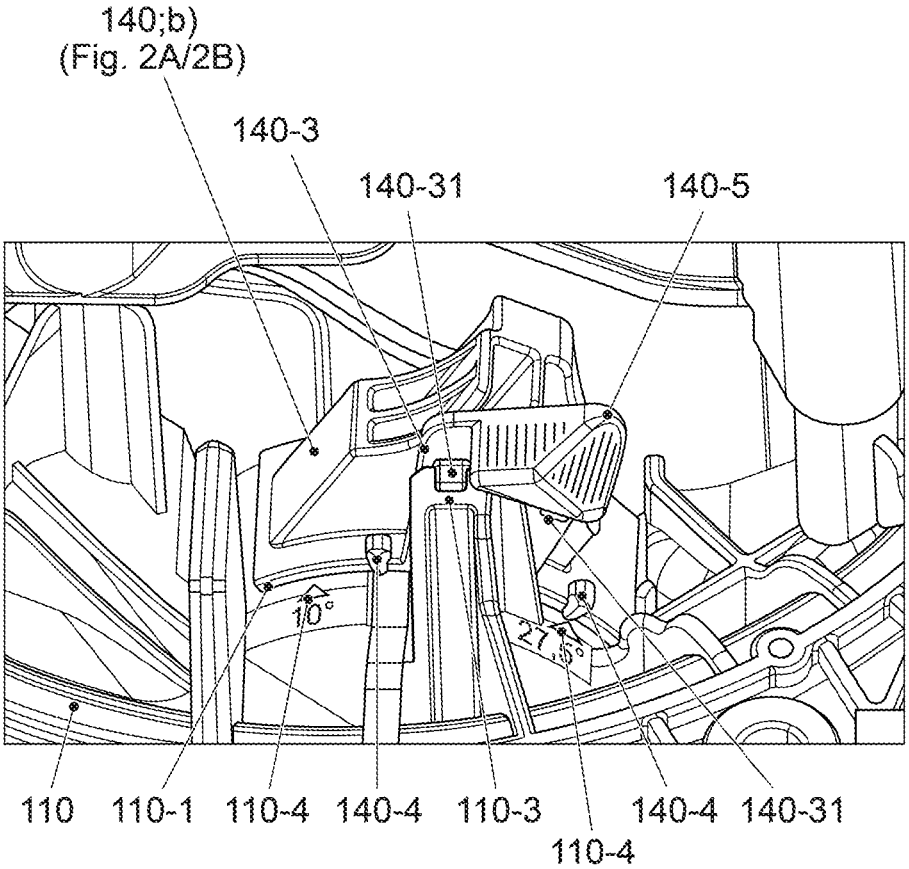
FIG. 6 shows a perspective representation of a detail of the unlocking unit to clarify the positioning of the switch unit in the particular switch point position.

FIG. 4 further shows positioning lugs 140-4. Positioning lugs 140-4 indicate to the worker the switch point position a) or b), because a corresponding angle specification of the particular switch angle α or β is marked with a positioning arrow 110-4 on the edge of receiving opening 110-1 of housing 110 (compare FIG. 6). In FIG. 6, positioning lug 140-4 points to positioning arrow 110-4 at which switch angle β (for example, 27.5°) is marked with a late trigger switch point according to shift point position b).

Figure 5:
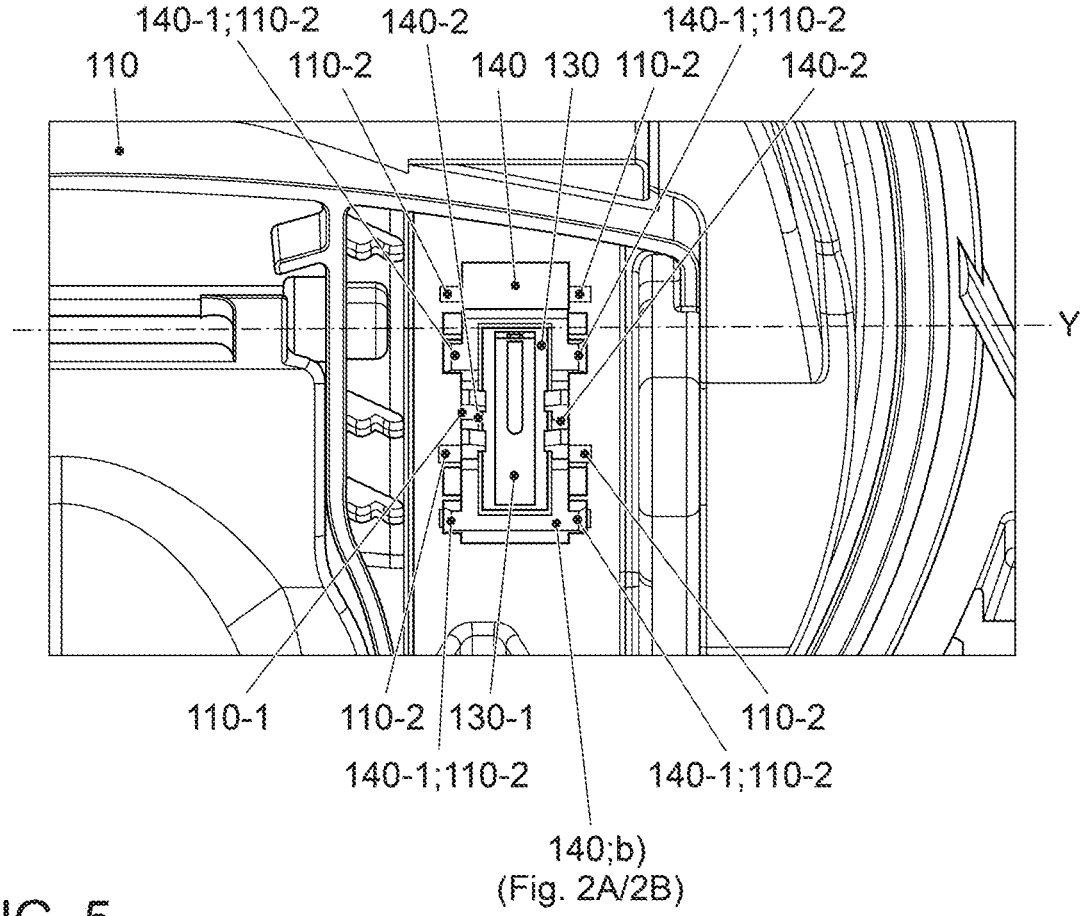
FIG. 5 shows a top plan view of a detail of the unlocking unit to clarify the positioning of the switch unit in the particular switch point position.

FIG. 5 shows, in a top plan view of holding element 140, essentially once again the arrangements already described in the description of FIG. 4 with a lateral viewing direction of holding element 140. In FIG. 5, the viewer looks radially with respect to the Y-pivot axis at holding element 140 and integrated switch unit 130 and active switch element 130-1.

FIG. 6 makes clear in a further perspective representation how the worker carries out the positioning of switch unit 130 in the respective switch point position a) or b. Positioning lugs 140-4 and positioning arrows 110-4 have already been discussed (compare FIG. 4 and the associated description). In FIG. 6, analogous to FIGS. 2A and 2B, holding element 140 is again positioned in the second switch point position b) with the switch angle β (for example, β=27.5).

Securing element 140-31 disposed on plate 140-3 engages in securing mount 110-3 in the locked position and secures holding element 140 and thus switch unit 130 against a displacement along receiving opening 110-1, viewed in the longitudinal direction of receiving opening 110-1. A movement from second switch point position b) with the switch angle β to the first switch point position a) with the switch angle α takes place by a pressure actuation by the worker on an actuating surface of a securing lever 140-5 of holding element 140. Securing lever 140-5 is part of plate 140-3 and a movement of securing lever 140-5 away from securing mount 110-3 into the plane of the sheet of paper leads to a disengagement of securing element 140-31 from securing mount 110-3. The worker then moves holding element 140, preferably with the aid of securing lever 140-5, into the first switch point position a) with the switch angle α, in which the other securing element 140-31 engages in the stationary securing mount 110-3, so that holding element 140 is secured again.

Finally, it is pointed out that according to the description, two switch point positions a) and b) are formed, resulting in two trigger switch points. It is understood that according to the invention, more than two switch point positions and trigger switch points can be realized, because holding element 140 and thus switch unit 130 can assume any position within the housing-side receiving opening 110-1.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. An unlocking unit for unlocking an openable closure element of a motor vehicle, the unlocking unit comprising:

a housing;

a switch unit; and an actuating element that is pivotable relative to the housing and is pivotable relative to the switch unit from an unactuated resting position to at least two actuating positions, wherein the switch unit is arranged in the housing and is adapted to be reversibly positioned in at least two different switch point positions relative to the housing, wherein different trigger switch points are assigned to the actuating element of the unlocking unit in accordance with a switch angle of the actuating element that is pivotable out of the unactuated resting position, and wherein the switch unit is positioned fixedly in a holding element which, in an assembled state of the unlocking unit, is positioned in the housing and is reversibly positioned relative to the housing in the at least two different switch point positions.

2. The unlocking unit according to claim 1, wherein the housing has a receiving opening which, in the assembled state of the unlocking unit, is penetrated at least by the switch unit or by the holding element with the switch unit positioned fixedly therein, so that in the unactuated resting position of the actuating element, and depending on the positioning of the switch unit in one of the at least two different switch point positions, the switch unit is positioned at a predeterminable distance from an actuating member of the actuating element.

3. The unlocking unit according to claim 2, wherein the at least two different switch point positions include a first switch point position and a second switch point position, wherein the at least two actuating positions include a first actuating position and a second actuating position, wherein the switch angle includes a first switch angle and a second switch angle, wherein the different trigger switch points include a first trigger switch point and a second trigger switch point, and wherein, starting from the unactuated resting position of the actuating element, and based on the positioning of the switch unit in the first switch point position, a first distance between the switch unit and the actuating member is set, which distance is overcome in the first actuating position upon actuation of the actuating element about the first switch angle, and whereby the first trigger switch point between the actuating member and the switch unit is effected.

4. The unlocking unit according to claim 2, wherein the at least two different switch point positions include a first switch point position and a second switch point position, wherein the at least two actuating positions include a first actuating position and a second actuating position, wherein the switch angle includes a first switch angle and a second switch angle, wherein the different trigger switch points include a first trigger switch point and a second trigger switch point, and wherein starting from the unactuated resting position of the actuating element, and based on the positioning of the switch unit in the second switch point position, a second distance between the switch unit and the actuating member is set, which distance is overcome in the second actuating position upon an actuation of the actuating element about the second switch angle, and whereby the second trigger switch point between the actuating member and the switch unit is effected.

5. The unlocking unit according to claim 2, wherein the holding element with the switch unit positioned fixedly therein is positioned displaceable relative to the housing in the receiving opening of the housing.

6. The unlocking unit according to claim 2, wherein the holding element and the switch unit are stationary relative to one another as a first prefabricated subassembly, and the actuating element and the actuating member are stationary relative to one another as a second prefabricated subassembly, which are assembled to form the unlocking unit, wherein the actuating element is pivotally mounted in the housing, and wherein the holding element is displaceably mounted in the receiving opening of the housing.

7. The unlocking unit according to claim 6, wherein the housing has an arcuate section at least in a region of the holding element so that the holding element positioned in the housing with the switch unit is positioned displaceable relative to the housing on a circular arc, and wherein a radius of the arc is disposed radially to a pivot axis of the actuating element that is pivotable relative to the housing.

8. The unlocking unit according to claim 1, wherein the unlocking unit is disposed in the openable closure element, the openable closure element being a tailgate of the vehicle.

9. A motor vehicle comprising at least one structural component in which an unlocking unit according to claim 1 is arranged.

10. The motor vehicle according to claim 9, wherein the at least one structural component is the openable closure element, the openable closure element being a tailgate of the vehicle.

* * * * *